United States Patent [19]

Benaway

[11] Patent Number: 5,040,757

[45] Date of Patent: Aug. 20, 1991

[54] WRIST SUPPORT FOR USE WITH AN OFFICE MACHINE HAVING A KEYBOARD

[76] Inventor: Dennis W. Benaway, 16100 N. Outer 40, Suite 250, Chesterfield, Mo. 63071

[21] Appl. No.: 595,603

[22] Filed: Oct. 11, 1990

[51] Int. Cl.[5] ..... B43L 15/00

[52] U.S. Cl. ..... 248/118.3; 248/918; 400/715

[58] Field of Search ..... 248/118, 118.1, 118.3, 248/118.5, 921, 922, 918, 133, 371, 188.2; 211/69.1; 400/715

[56] References Cited

U.S. PATENT DOCUMENTS

| | | | |
|---|---|---|---|
| 1,915,320 | 6/1933 | Jones | 248/188.2 |
| 3,993,275 | 11/1976 | Lucas | 248/188.2 |
| 4,482,063 | 11/1984 | Berke et al. | 248/118 X |
| 4,482,064 | 11/1984 | Berke et al. | 248/118 X |
| 4,545,554 | 10/1985 | Latino et al. | 248/118.3 X |
| 4,709,972 | 12/1987 | LaBuddee et al. | 312/302 X |
| 4,913,390 | 4/1990 | Berke | 248/118.3 X |

*Primary Examiner*—Ramon O. Ramirez

*Attorney, Agent, or Firm*—Polster, Polster and Lucchesi

[57] ABSTRACT

A keyboard operator arm, wrist or hand support has a stepped top surface to permit quick, facile adjustment of the height and distance of the keyboard from the support surface without use of any moving mechanical parts. The support is a simple, unitary member which can be inexpensively fabricated from injection molded plastic or wood.

17 Claims, 1 Drawing Sheet

WRIST SUPPORT FOR USE WITH AN OFFICE MACHINE HAVING A KEYBOARD

BACKGROUND OF THE INVENTION

The invention relates to office machine accessories and more particularly to a wrist support for use with office machines having a keyboard such as a computer terminal keyboard. While the invention is primarily intended to support the wrists of a keyboard operator, it is recognized that it may also be used to support the lower arms or hands of the operator, if desired.

The operation of a computer keyboard over extended periods of time involves a great number of muscular activities of the hands, wrists, arms and shoulders. The fact that the entire extremity is suspended without support may lead to greater physical strain of the hands, arms, shoulders and even the back than is necessary. Without proper support of the arms, wrists or hands, premature fatigue and reduced productivity may result. Further, it has recently become known that improper support or positioning of the arms, wrists or hands in front of the keyboard over a a long period of time may increase the likelihood of the operator acquiring a painful and debilitating condition known as Carpal Tunnel Syndrome.

The prior art has recognized and addressed the problems enumerated above and has developed many keyboard operator supports such as those shown in U.S. Pat. Nos. 4,482,063; 4,482,064; 4,545,554; 4,709,972; and 4,913,390. These keyboard operator supports can be placed in two basic categories: 1) Those which provide adjustability of the wrist or hand support surface relative to the position of the keyboard using a relatively expensive, mechanical adjusting means having moving parts; or 2) those which are simple structures with no means for relative position adjustment.

SUMMARY OF THE INVENTION

It is an object of the present invention to provide a simple, inexpensive arm, wrist, or hand support for a keyboard operator which can accomplish relative position adjustment between the operator support and the keyboard without the need for moving parts.

It is a further object to provide a keyboard operator support which is fabricated and formed in a unique manner to help maintain suitable positioning of the wrists relative to the keyboard, thereby reducing arm, shoulder and back strain and the likelihood of acquiring the debilitating condition known as Carpal Tunnel Syndrome.

It is a still further object of the invention to provide a keyboard operator support which is extremely simple and inexpensive to manufacture.

The keyboard operator arm, wrist or hand support of the present invention is preferably fabricated as a unitary member from injection molded plastic, wood or the like and has a generally flat horizontal bottom adapted to rest upon a desk top, or the like. The support member is preferably approximately as wide as the keyboard and is provided with a top surface of generally stepped configuration having a relatively low forward surface portion on which at least the portion of the keyboard proximate the operator is adapted to rest. The top surface also includes a rear surface portion higher than the forward surface portion which is adapted to support the lower arms, wrists or hands of the keyboard operator. The support surface is sloped slightly downwardly toward the operator to maintain the wrists in correct position for reducing the possibility of Carpal Tunnel Syndrome.

In order to provide for adjustment of the relative position of the keyboard to the support surface, the top surface of the support member includes a plurality, preferably three, stepped surface portions of increasing height from the forward surface portion to the rear support surface portion. Each of the stepped surface portions is dimensioned to support the portion of the keyboard proximate the keyboard operator such that the position of the keyboard relative to the support surface may be varied by selective placement of the keyboard on either the forward minimal height surface or one of the intermediate stepped surfaces.

BRIEF DESCRIPTION OF THE DRAWINGS

These as well as the objects and advantages will become more apparent with reference to the following description of a preferred embodiment of the invention wherein.

DETAILED DESCRIPTION OF THE PREFERRED EMBODIMENT

Figure 1:
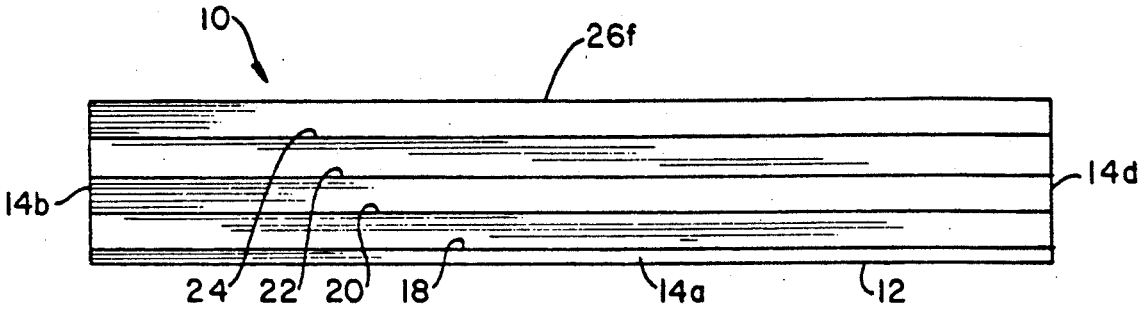
FIG. 1 is a rear elevational view of the preferred embodiment showing the rear side of the invention adapted to be placed away from the keyboard operator and towards the keyboard.

With reference to the drawings, there is shown a preferred embodiment of the keyboard operator lower arm, wrist or hand support according to the principles of the present invention and generally referred to by the numeral 10. Support 10 is preferably fabricated as a unitary member from injection molded plastic, wood or the like and includes a generally flat horizontal bottom 12 which may be solid or may be defined only by the edges of the four vertical sides 14*a*, 14*b*, 14*c* and 14*d*. It is also contemplated that short legs or non-skid pads (not shown) may be provided at the four corners of the bottom. At any rate, bottom 12 is adapted to rest on the horizontal surface of a desk top, or the like.

Member 10 includes a top surface generally indicated by numeral 16 having a forward surface portion 18 of minimal height; i.e., about ¼ to ⅓ inch. Rearward and adjacent to forward surface portion 18 is a first step portion 20 rising approximately ¼ to ½ inch above forward surface portion 18. Rearward and adjacent to first step portion 20 is a second step portion 22 rising above first step portion 20 approximately ½ inch. Rearward and adjacent to second step portion 22 is a third step portion 24 rising approximately ½ inch above second step portion 22. Rearward and adjacent to third step portion 24 is the operator support portion 26 having the forward edge 26*f* thereof approximately ½ inch above third step portion 24.

Support portion 26 is configured to have a rounded front edge 26*f* with a slight downward slope from forward edge 26*f* to rearward edge 26*r* to provide a comfortable surface and proper positioning of the wrists of the keyboard operator to reduce the likelihood of muscle strain and the possibility of Carpal Tunnel Syndrome.

The preferred overall dimensions of the invention when utilized with a standard computer keyboard are approximately 5¼ inches front to back, approximately 2½ inches high and approximately 19 inches in width, i.e., side to side. It is noted that the height of each of the stepped surface portions 20, 22 and 24 are approximately the same as the height of the portion of the keyboard proximate the keyboard operator, and the width of member 10 is approximately the same as the width of a standard keyboard.

Figure 2:
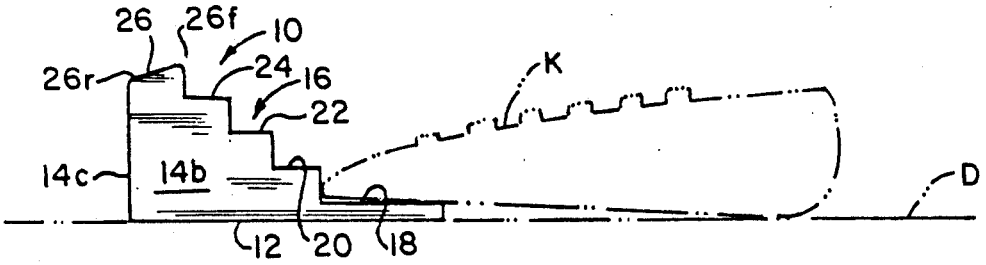
FIG. 2 is a side elevational view showing the left side of FIG. 1 and showing a keyboard in phantom in one position.
Figure 3:
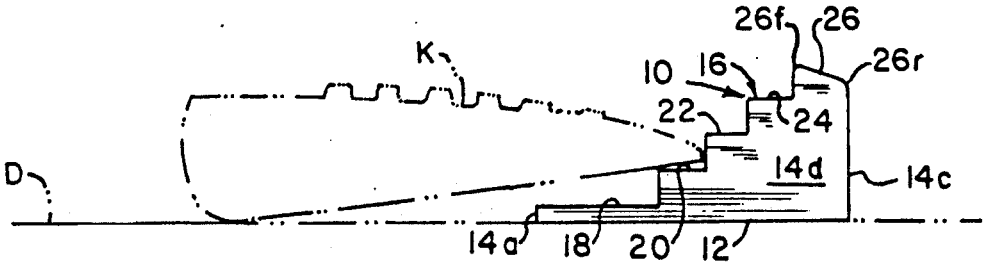
FIG. 3 is a side elevational view showing the right side of FIG. 1 and showing a keyboard in phantom in an alternate position.
Figure 4:
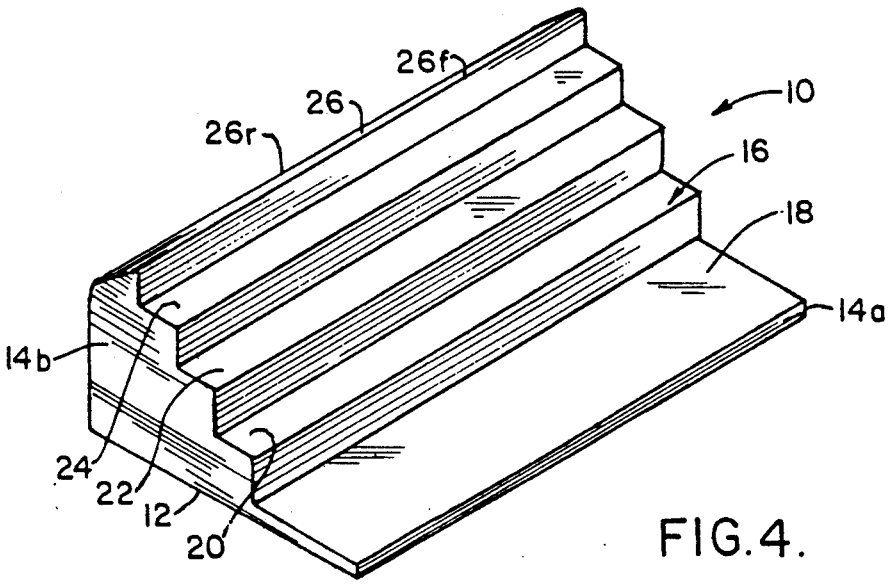
FIG. 4 is an isometric view of the preferred embodiment.

In operation, a computer keyboard K (shown in phantom line in FIGS. 2 and 3) may have the portion thereof proximate the operator placed upon forward surface portion 18 of member 10 with the portion of the keyboard K furthest from the operator resting on a desk top D as shown in FIG. 2. The operator may then rest his lower arms, hands or preferably his wrists on support surface portion 26. If the operator has smaller hands or desires a change of relative position between his hands and the keyboard, the operator may reposition the keyboard such that the portion of the keyboard proximate the operator rests on first step portion 20 as shown in FIG. 3.

The operator has the choice of positioning the keyboard on any of forward surface portion 18 or step portions 20, 22 and 24 in order to provide four distinct keyboard positions relative to the support surface position 26.

It is also contemplated that when the keyboard K is positioned on any of the surface portions below step portion 24, then step portion 24 may be utilized to accommodate a computer command template, or the like.

It is readily apparent from the foregoing that the present invention provides for a simple, inexpensive keyboard operator support which allows for quick, facile adjustment of the relative position between the keyboard and the operator support surface without the necessity of moving parts.

While a preferred embodiment of the invention has been described hereinabove using specific terms, it is to be recognized that numerous modifications may be made thereto without departing from the spirit of the invention. For example, non-skid material may be adherred to surfaces 18, 20, 22 and 24, or a padded member may be affixed to the top of support surface 26. Therefore, the scope of the invention should be determined solely by the following claims.

What is claimed is:

1. A keyboard operator arm, wrist or hand support comprising:

a member having a bottom adapted to rest upon a horizontal surface;

said member having a top surface including a forward surface portion in a relatively low, generally horizontal plane adapted to support at least the portion of a keyboard which is proximate the keyboard operator, and a rear surface portion higher than said forward surface portion adapted to support the lower arms, wrists or hands of the keyboard operator;

said top surface including at least one generally horizontal, stepped surface portion between said forward surface portion and said rear surface portion;

said at least one stepped surface portion being higher than said forward surface portion and lower than said rear surface portion; and said at least one stepped surface portion being of such dimension to support the portion of a keyboard which is proximate the keyboard operator.

2. The support as specified in claim 1 wherein:

said rear surface portion is sloped downwardly and rearwardly toward the keyboard operator.

3. The support as specified in claim 1 wherein:

said top surface includes a plurality of generally horizontal, stepped surface portions between said forward surface portion and said rear surface portion;

said stepped surface portions being increasingly higher from said forward surface portion to said rear surface portion; and each stepped surface portion being of such dimension to support the portion of a keyboard which is proximate the keyboard operator.

4. The support as specified in claim 3 wherein:

the height of each of said stepped surface portions from an adjacent lower surface portion being approximately the same as the height of the portion of the keyboard proximate the keyboard operator.

5. The support as specified in claim 3 wherein:

the width of said member is approximately the same as the width of the keyboard.

6. The support as specified in claim 1 wherein:

said member is fabricated of molded plastic material.

7. The support as specified in claim 1 wherein:

said member is fabricated of wood.

8. A keyboard operator wrist, hand or arm support comprising:

a member having a top surface including a forward surface portion of minimal height, a first step portion adjacent said forward surface portion and higher than said forward surface portion, a second step portion adjacent said first step portion and higher than said first step portion, a third step portion adjacent said second step portion and higher than said second step portion, and a support portion rearward of said third step portion and higher than said third step portion;

each of said forward surface portion and said stepped portions being dimensioned to support the portion of a keyboard proximate the keyboard operator such that the position of the keyboard relative to said support surface may be varied by selective placement of the keyboard on one of said forward or stepped surfaces.

9. The keyboard operator support as specified in claim 8 wherein:

said support surface slopes downwardly toward the operator.

10. The keyboard operator support as specified in claim 8 wherein:

said support is a unitary member.

11. The keyboard operator support as specified in claim 10 wherein:

said support has a generally flat horizontal bottom.

12. The keyboard operator support as specified in claim 10 wherein;

the width of said member is approximately the same as the width of the keyboard.

13. The keyboard operator support as specified in claim 10 wherein:

said member is fabricated of molded plastic material.

14. The keyboard operator support as specified in claim 10 wherein:

said member is fabricated of wood.

15. The keyboard operator support as specified in claim 8 wherein:

non-skid means are provided on the bottom of said member for providing lateral stability of said member on a horizontal surface.

16. The keyboard operator support as specified in claim 8 wherein:

non-skid means are provided on said forward surface portion and said step portions for providing stability of the keyboard on said step portions and said forward portion.

17. The keyboard operator support as specified in claim 8 wherein:

padded means for providing added comfort is provided on said support surface.

* * * * *